US006186591B1

(12) United States Patent
Pajerski

(10) Patent No.: US 6,186,591 B1
(45) Date of Patent: Feb. 13, 2001

(54) TABLE WITH SELF-ADJUSTING MIDFRAME SUPPORT

(75) Inventor: Francis L. Pajerski, Elkhorn, WI (US)

(73) Assignee: Palmer Snyder Furniture Co., Milwaukee, WI (US)

( * ) Notice: Under 35 U.S.C. 154(b), the term of this patent shall be extended for 0 days.

(21) Appl. No.: 09/182,267

(22) Filed: Oct. 29, 1998

(51) Int. Cl.[7] ..... A47B 3/08; A47B 3/14

(52) U.S. Cl. ..... 297/159.1; 297/158.4; 297/344.12; 108/125; 108/129

(58) Field of Search ..... 297/159.1, 143, 297/158.4, 344.12, 344.15; 108/125, 126, 129, 130

(56) References Cited

U.S. PATENT DOCUMENTS

| | | | | |
|---|---|---|---|---|
| D. 268,971 | | 5/1983 | Reineman | D6/45 |
| 1,360,052 | * | 11/1920 | Streich | 108/129 |
| 2,503,199 | * | 4/1950 | Goldblatt et al. | 108/129 |
| 2,769,650 | * | 11/1956 | Larson | 108/125 X |
| 2,873,987 | * | 2/1959 | Larson | 108/125 X |
| 3,055,705 | | 9/1962 | Wilson | 297/159.1 |
| 3,075,809 | | 1/1963 | Wilson | 297/158.4 |
| 3,082,025 | * | 3/1963 | Larson | 108/129 X |
| 3,099,481 | * | 7/1963 | Bue | 297/158.4 |
| 3,101,062 | * | 8/1963 | Kanzelberger | 297/158.4 X |
| 3,109,678 | * | 11/1963 | Wilson | 297/158.4 |
| 3,212,463 | * | 10/1965 | Anderson et al. | 297/158.4 X |
| 3,334,930 | * | 8/1967 | Larson | 108/125 X |
| 3,511,532 | | 5/1970 | Tringali et al. | 297/159 |
| 3,715,143 | | 2/1973 | Gerken et al. | 297/158.4 |
| 3,797,884 | * | 3/1974 | Gutierrez | 297/158.4 |
| 4,101,164 | | 7/1978 | Urdanoz | 297/159.1 |
| 4,143,602 | | 3/1979 | Brunn . | |
| 4,596,196 | | 6/1986 | Gunter et al. | 297/158.4 |
| 5,325,794 | | 7/1994 | Hontani . | |

* cited by examiner

*Primary Examiner*—Peter M. Cuomo
*Assistant Examiner*—Rodney B. White
(74) *Attorney, Agent, or Firm*—Jansson, Shupe, Bridge & Munger, Ltd.

(57) ABSTRACT

An institutional table is of the type in which the table tops and the seats for table users are assembled as an integral (as well as foldable and storable) structure. The table has first and second flat table tops pivotally coupled to one another at a hinge section. A center leg component is coupled to the table tops at the hinge section and supports the table at such hinge section when the table is erected ready for use. The table has a plurality of seat support frames coupled to the table tops. At least one of those seat support frames includes a self-adjustable frame coupled to the first table top by a sliding joint. In a specific embodiment, the seat support frames includes first and second endframe seat supports coupled to the first and second table tops, respectively. Two of the seat support frames, i.e., the first and second midframe seat supports are, respectively, between the center leg component and one of the endframe seat supports. Sliding joints at the midframe seat supports permits both of such seat supports to contact the floor when a user is seated.

12 Claims, 4 Drawing Sheets

TABLE WITH SELF-ADJUSTING MIDFRAME SUPPORT

FIELD OF THE INVENTION

This invention relates generally to horizontally supported planar surfaces and, more particularly, to tables, e.g., institutional tables, of the type having integral seats and seat supporting frames.

BACKGROUND OF THE INVENTION

Schools, churches, universities and the like are primary users of tables of the type generally known as institutional tables. Such tables are aptly named because they represent a good value and they are rugged and able to withstand hard use. Often, such tables are configured to be folded for storage and/or movement from place to place on wheels and to be unfolded for use. Examples of such tables are disclosed in U.S. Pat. No. 3,511,532 (Tringali et al.) and U.S. Pat. No. 3,715,143 (Gerken et al.).

Such tables often have a center leg and two outer legs, each with seats mounted to them. Legs intermediate the center and outer legs also have seats mounted to them and are intended to provide additional points of floor-contacting support. However, that occurs only if (a) the entire table structure is fabricated with such accuracy that the points of contact of all of the legs define a plane, or (b) the "unevenness" of the lower ends of the legs and the unevenness of the floor surface exactly correspond. Usually, neither occurs.

As a result, an intermediate leg having mounted, unoccupied seats might not contact the floor. On the other hand, an intermediate leg having occupied seats may unduly stress the table as the weight of the user urges the intermediate leg into contact with the floor. And, of course, it is possible that the intermediate legs might be too long to permit the center and outer legs to firmly contact the floor.

The known prior work in this field does not address this problem. Certainly, the table disclosed in the Tringali et al. patent does not. It presumes a center leg support that contacts the floor and permits one to adjust the height of the inner ends of the table top sections by loosening bolts, making the height adjustment and then re-tightening the bolts.

A new table which addresses problems and shortcomings of the prior art would be a notable advance in this field of technology.

OBJECTS OF THE INVENTION

It is an object of the invention to provide a table which overcomes certain problems and shortcomings of the prior art.

Another object of the invention is to provide a table in which intermediate legs automatically adjust to unevenness in the floor on which the table is erected.

Yet another object of the invention is to provide a table in which all seat-supporting legs contact the floor, irrespective of a degree of floor unevenness.

Another object of the invention is to provide a table which helps avoid stressing table components to which legs are coupled. How these and other objects are accomplished will become apparent from the following descriptions and from the drawings.

SUMMARY OF THE INVENTION

The invention involves a table of the type used in institutions, e.g., elementary schools, hospitals, universities and the like. The table tops and the seats are assembled as an integral (as well as foldable and storable) structure. When the table is in use, the table tops are horizontal and coplanar. And when the table is folded for storage or re-positioning, such table tops are vertical and parallel.

The table is of the type which includes first and second table tops pivotally coupled to one another at a hinge section. A center leg component is coupled to the table tops at the hinge section and provides center support when the table is erected for use. Each of a plurality of seat support frames is also coupled to the table tops and such seat support frames are of the type on which one or more user seats are mounted. The plurality of seat support frames includes an adjustable frame coupled to the first table top by a sliding joint.

More specifically, the sliding joint includes an elongate slot and a fastener through it. The first table top includes a working member and a beam support and, most preferably, the elongate slot is in the beam support. The adjustable frame has an upward terminus with a circular aperture therethrough and the fastener extends through the aperture and the elongate slot. While forming the slots in the beam support and forming the circular aperture in the frame terminus has advantages from a manufacturing standpoint, forming the frame terminii with slots and the beam support with apertures is certainly a useful configuration.

Other aspects of the invention involve a floor-supported table including the first and second table tops pivotally coupled to one another at a hinge section and having the center leg component coupled as described above. First and second endframes are coupled to the first and second table tops, respectively.

In addition, first and second midframes are coupled to the first and second table tops, respectively, by first and second sliding joints, respectively. The table is thereby configured to automatically permit contact of both of the midframes with the floor when users are seated on one of the seats of each midframe.

When the table is erected for use, the first and second table tops have, respectively, first and second spaced distal ends. The tops are preferably of equal length and, in that typical event, an axis along the center leg component is equidistant from each of the distal ends. The first midframe is between the axis and the first distal end. Similarly, the second midframe is between the axis and the second distal end.

In an embodiment configured to seat more users, the table has third and fourth midframes coupled to the first and second table tops, respectively. Such coupling is by first and second sliding joints, respectively.

Each of the first and second table tops includes a flat, "board-like" working member (the top surface of which is used by those seated at the table) and a beam support beneath and attached to the working member. The first sliding joint includes a first elongate slot in the beam support of the first table top and the first midframe has a terminus with a circular aperture through it. A fastener extends through the aperture and the first elongate slot.

The first and second sliding joints each include, respectively, first and second elongate slots. Such elongate slots each include and define a longitudinal axis. When the table is erected for use, the longitudinal axes of the first and second elongate slots are substantially parallel to the axis along the center leg component. It is to be understood that slots which are parallel to one another and to the axis along the center leg component are highly preferred. However, slots which are somewhat angled with respect to one another are considered to be within the scope and spirit of the invention.

Further details regarding the invention are set forth in the following detailed descriptions and in the drawings.

BRIEF DESCRIPTIONS OF THE DRAWINGS

Figure 4A:
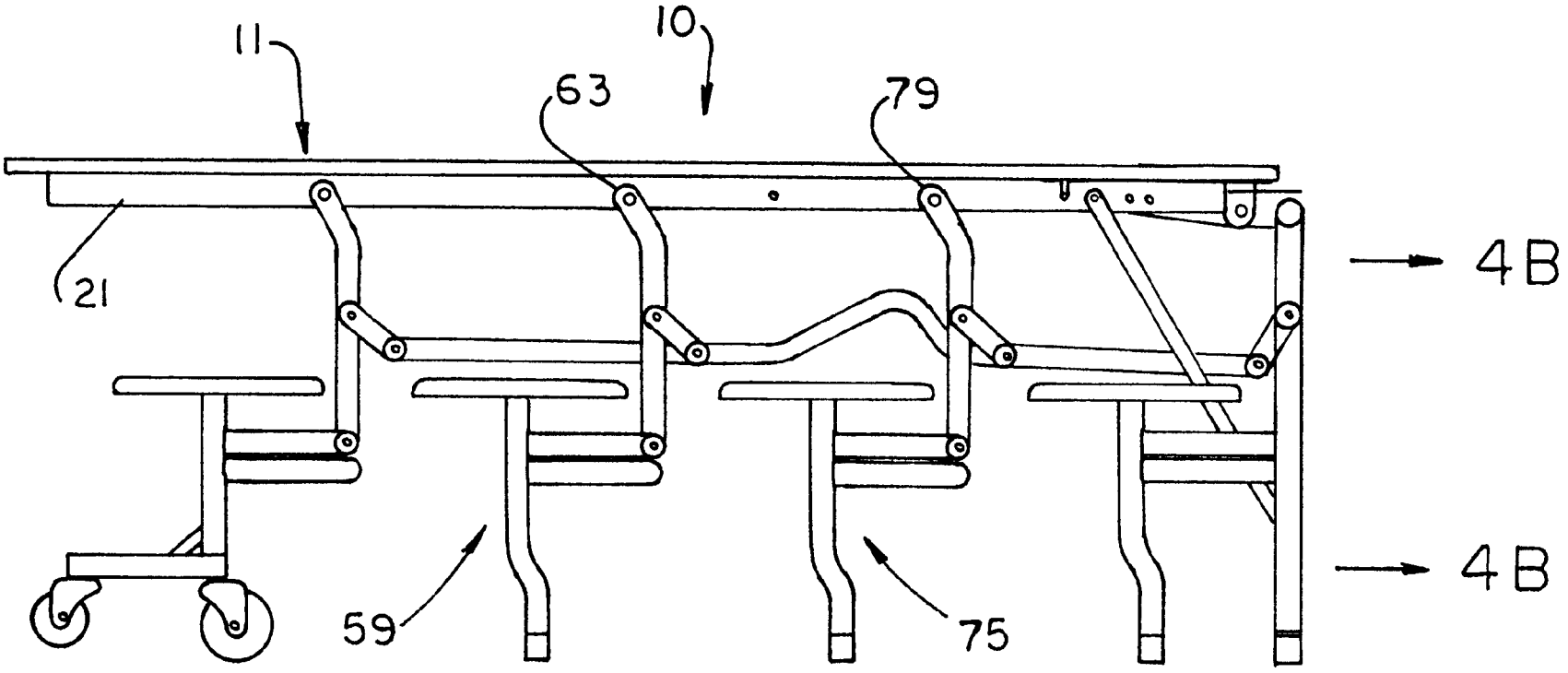
Figure 4B:
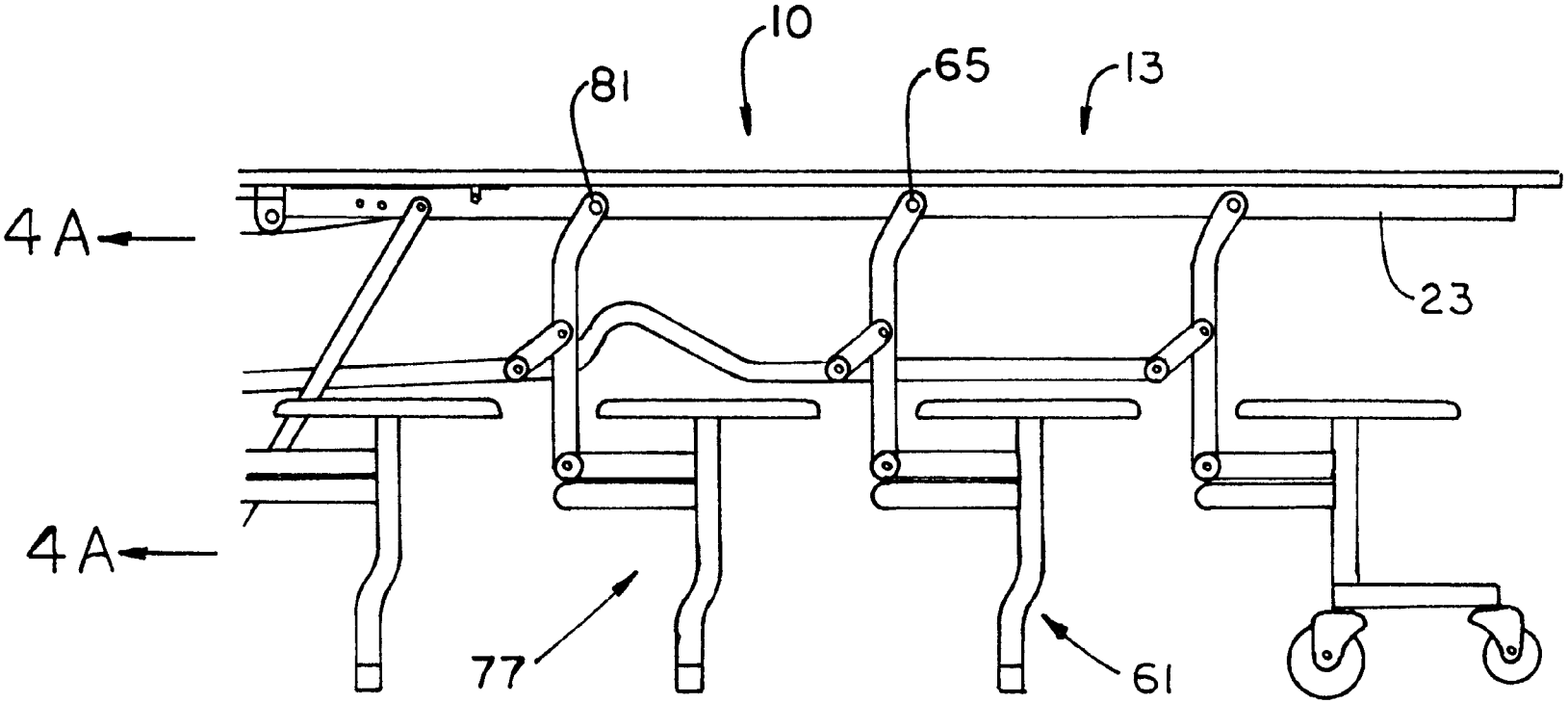

FIGS. 4A and 4B, taken together, constitute an elevation view of another embodiment of the table of the invention.

Figure 5:
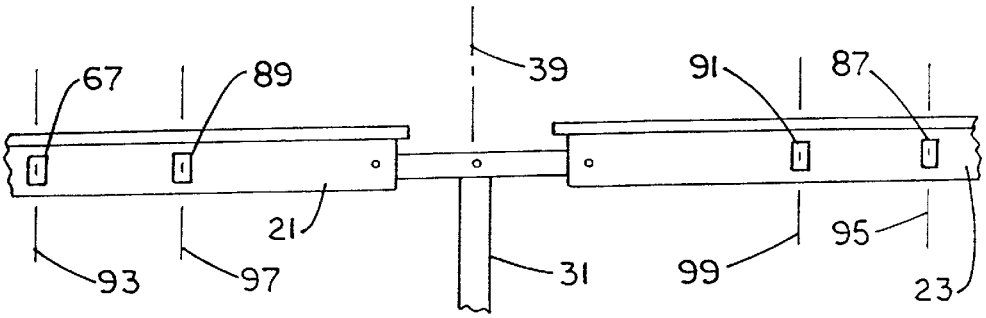

FIG. 5 is an elevation view of aspects of the table of FIGS. 4A and 4B. Parts are broken away.

DETAILED DESCRIPTIONS OF PREFERRED EMBODIMENTS

Figure 1:
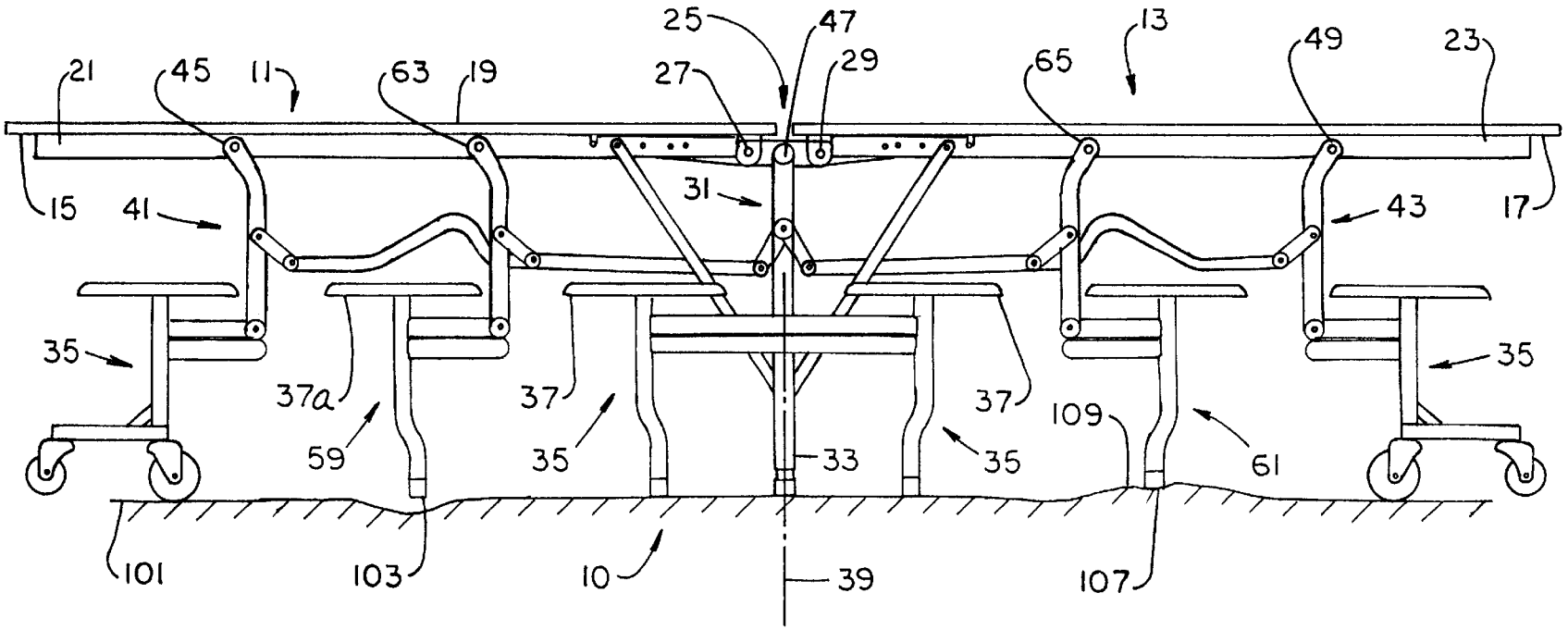
FIG. 1 is an elevation view of one embodiment of the table of the invention.

Referring to FIG. 1, one embodiment of an institutional table 10 has first and second table tops 11, 13, respectively, which have spaced distal ends 15, 17, respectively. Such tops 11, 13 are often made of particle board, laminated board or the like and have a upper surface 19 formed by, e.g., a plastic laminate layer. (The surface 19 is "upper" when, as shown in FIG. 1, the table 10 is erected for use.) When the table 10 is in use, the table tops 11, 13 are horizontal and coplanar.

Beneath and attached to each top 11, 13 is a beam support and FIG. 1 shows first and second beam supports 21, 23, respectively. Such supports 21, 23 add rigidity to the respective tops 11, 13 and provide structure to which certain seat support frames are coupled.

The tops 11, 13 (with attached supports 21, 23) are pivotally coupled to one another by a hinge section 25, the pivot axes for which are at locations 27 and 29. A center leg component 31 is coupled to the table tops 11, 13 at the hinge section 25 and provides center support when the table 10 is erected for use. (It is to be appreciated that the leg component 31 has two floor-contacting legs, only one, leg 33, of which is visible in FIG. 1. The other leg is hidden behind leg 33.)

The leg component 31 has a pair of seat assemblies 35 mounted to it in the manner shown. The seats 37, of such assemblies 35 are generally parallel to the floor, irrespective of whether the table 10 is folded for storage or erected for use. The tops 11, 13 are preferably of equal length and, in that typical event, an axis 39 along the center leg component 31 is equidistant from each of the distal ends 15, 17.

The table 10 also includes first and second endframes 41, 43, respectively, which are coupled to the first and second table tops 11, 13, respectively. More specifically, such endframes 41, 43 are pivotally attached to the first and second beam supports 21, 23, respectively, which, in turn, are rigidly attached to the tops 11, 13, respectively. Each such endframe 41, 43 also has a seat assembly 35 mounted to it.

Figure 2:
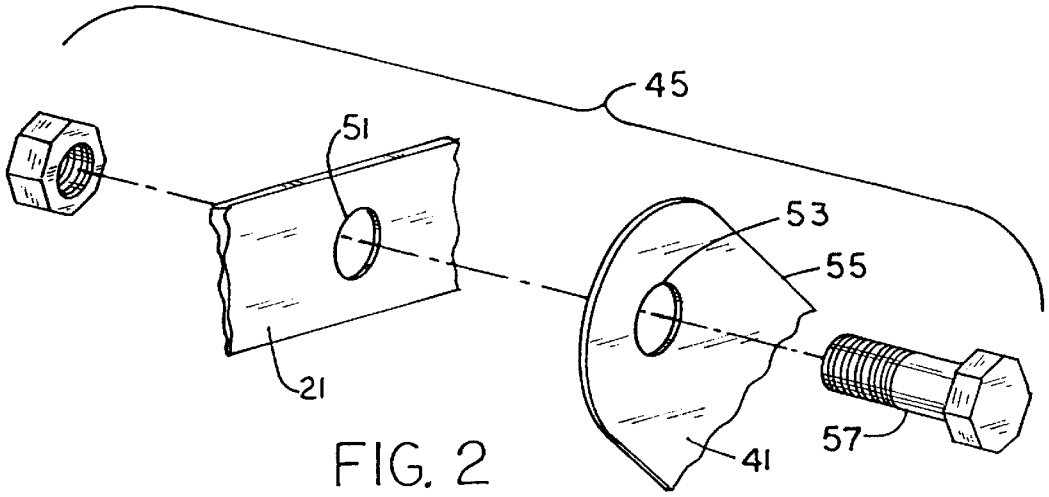
FIG. 2 is an exploded perspective view of a non-sliding joint used in the table of FIG. 1. Parts are broken away.

Referring also to FIG. 2, the joints 45, 47, 49 at which the first endframe 41, leg component 31, and second endframe 43, respectively, are attached are, preferably, what might be termed non-sliding joints. FIG. 2 shows the joint 45 and persons of ordinary skill will recognize that the joints 47, 49 are substantially identical thereto is construction and operating principle. The joint 45 includes a circular hole 51 in the beam support 21 and a circular hole 53 in the upper terminus 55 of the first endframe 41. A fastener 57, e.g., a bolt or the like, passes through both holes 53, 51 with only slight clearance and since such holes 53, 51 are circular, the joints 45, 47, 49 permit pivoting movement but are incapable of permitting sliding movement.

Figure 3:
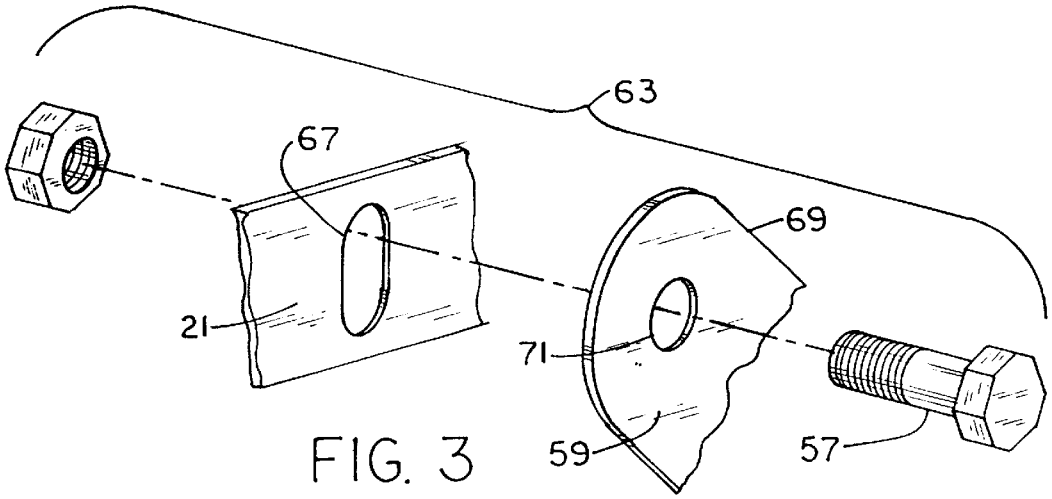
FIG. 3 is an exploded perspective view of a sliding joint used in the table of FIG. 1. Parts are broken away.

Referring again to FIG. 1, adjustable first and second midframes 59, 61, respectively, are coupled to the first and second table tops 11, 13, respectively, by first and second sliding joints 63, 65, respectively. Referring also to FIG. 3 (which shows the first sliding joint 63), the joint 63 includes an elongate slot 67 in the beam support 21. The midframe 59 has an upper terminus 69 with a circular aperture 71 through it and the fastener 57 extends through the aperture 71 and through the elongate slot 67. By virtue of an elongate slot, like slot 67, the joints 63, 65 are adjustable by sliding. When the table 10 is erected for use, the first midframe 59 is between the axis 39 and the first distal end 15. Similarly, the second midframe 61 is between the axis 39 and the second distal end 17. While forming the slot 67 in the beam support 21 and forming the circular aperture 71 in the frame terminus 69 has advantages from a manufacturing standpoint, forming the midframe terminii 69 with respective slots like slot 67 and forming the beam support 21 with circular apertures like aperture 71 is certainly a useful configuration.

Referring also to FIGS. 4A and 4B, another embodiment of the table 10 is configured to seat more users. Such table 10 has adjustable first and second midframes 59, 61, respectively, as well as third and fourth midframes 75, 77, respectively, which are coupled to the first and second table tops 11, 13, respectively, and (more particularly), which are attached to the first and second beam supports 21, 23 attached beneath the tops 11, 13. Such coupling is by third and fourth sliding joints 79, 81, respectively. Most preferably, such joints 79, 81 are constructed and arranged like the joint 63 shown in FIG. 3 and need not be further described.

Referring now to FIG. 5, the joints 63, 79, 81, 65 have first, second, third and fourth elongate slots 67, 87, 89, 91, respectively. The slots 67, 89 are in the first beam support 21 while the slots 91, 87 are in the second beam support 23. Such elongate slots 67, 87, 89, 91 each include and define a longitudinal axis 93, 95, 97, 99, respectively. When the table 10 is erected for use, the longitudinal axes 93, 95 of the first and second elongate slots 67, 87, respectively, are substantially parallel to the axis 39 along the center leg component 31. Similarly, the longitudinal axes 97, 99 of the third and fourth slots 89, 91, respectively, are substantially parallel to the axis 39. (It is to be understood that slots 67, 89, 91, 87 which are parallel to one another and to the axis 39 along the center leg component are highly preferred. However, slots which are somewhat angled with respect to one another are considered to be within the scope and spirit of the invention.)

Considering FIG. 1 again and assuming an uneven floor 101, when the table 10 is unfolded and erected for use, there is a good possibility that only the center leg component 31 and the endframes 41, 43 will touch the floor 101. However, when a persons sit on the seat 37*a,* the sliding joint 63 permits the midframe 59, to shift downwardly slightly so that the lower end 103, of such midframe 59 contact the floor 101 at the depression 105 and support the person's weight. Similarly, the sliding joint 65 will permit the midframe 61 to shift upward slightly as its lower end 107 contacts the raised portion 109 of the floor 101.

While the principles of the invention have been shown and described in connection with preferred embodiments, it is to be understood clearly that such embodiments are by way of example and are not limiting.

What is claimed:

1. A table including:

first and second table tops pivotally coupled to one another at a hinge section;

a center leg component coupled to the table tops at the hinge section; and a plurality of seat support frames coupled to the table tops; and wherein:

the plurality of seat support frames each include a foldable and adjustable frame coupled to the table top by a sliding joint permitting automatic, substantially vertical adjusting movement of the seat support frames toward and away from a floor surface along a substantially vertical line;

whereby, the seat support frames are adjustable to accommodate irregular floor surfaces.

2. The table of claim 1 wherein:

the sliding joint includes an elongate slot and a fastener therethrough.

3. The table of claim 2 wherein:

the first and second table tops include a beam support attached beneath each table top;

the elongate slot is in the beam support;

the adjustable frame has a terminus with a circular aperture therethrough; and the fastener extends through the aperture and the elongate slot.

4. A floor-supported table including:

first and second table tops pivotally coupled to one another at a hinge section;

a center leg component coupled to the table tops at the hinge section;

first and second endframes coupled to the first and second table tops, respectively; and first and second foldable and adjustable midframes coupled to the first and second table tops, respectively, by first and second sliding joints, respectively, thereby configuring the table to permit automatic, substantially vertical adjusting movement of both of the midframes along a substantially vertical line so that the midframes may make contact with the floor.

5. The table of claim 4 wherein:

the first and second table tops have, respectively, first and second spaced distal ends;

an axis along the center leg component is equidistant from each of the distal ends;

the first midframe is between the axis and the first distal end.

6. The table of claim 5 wherein:

the first and second sliding joints include, respectively, first and second elongate slots;

the first and second elongate slots each include a longitudinal axis; and the longitudinal axes of the first and second elongate slots are substantially parallel to the axis along the center leg component.

7. The table of claim 5 wherein the second midframe is between the axis and the second distal end.

8. The table of claim 4 including:

third and fourth midframes coupled to the first and second table tops, respectively, by third and fourth sliding joints, respectively, thereby configuring the table to permit contact of all of the midframes with the floor.

9. The table of claim 4 wherein:

the first and second table tops each include a working member and a beam support;

the first sliding joint includes a first elongate slot in the beam support of the first table top;

the first midframe has a terminus with a circular aperture therethrough; and a fastener extends through the aperture and the first elongate slot.

10. A folding table including:

first and second table tops pivotally coupled to one another at a hinge section;

a center leg component coupled to the table tops at the hinge section; and a plurality of seat support frames coupled to the table tops; and wherein:

the plurality of seat support frames each include a foldable and adjustable frame coupled to the table top by a sliding joint permitting automatic, substantially vertical adjusting movement of the seat support frames when the table is in an unfolded position ready for use;

whereby, the seat support frames are adjustable to accommodate irregular floor surfaces.

11. The table of claim 1 wherein:

the sliding joint includes an elongate slot and a fastener therethrough.

12. The table of claim 11 wherein:

the first and second table tops include a beam support attached beneath each table top;

the elongate slot is in the beam support;

the adjustable frame has a terminus with a circular aperture therethrough; and the fastener extends through the aperture and the elongate slot.

* * * * *